US010449465B2

(12) United States Patent
Hyun

(10) Patent No.: US 10,449,465 B2
(45) Date of Patent: Oct. 22, 2019

(54) TOY HAVING PUSH LOCK AND DRIVE MECHANISM

(71) Applicant: John Mathew Hyun, Vernon, CA (US)

(72) Inventor: John Mathew Hyun, Vernon, CA (US)

( * ) Notice: Subject to any disclaimer, the term of this patent is extended or adjusted under 35 U.S.C. 154(b) by 0 days.

(21) Appl. No.: 16/144,368

(22) Filed: Sep. 27, 2018

(65) Prior Publication Data

US 2019/0126160 A1 May 2, 2019

Related U.S. Application Data

(60) Provisional application No. 62/577,726, filed on Oct. 27, 2017.

(51) Int. Cl.

| | |
|---|---|
| ***A63H 29/24*** | (2006.01) |
| ***A63H 17/26*** | (2006.01) |
| ***A63H 29/04*** | (2006.01) |

(52) U.S. Cl.

CPC ..... *A63H 29/24* (2013.01); *A63H 17/26* (2013.01); *A63H 29/04* (2013.01)

(58) Field of Classification Search

CPC ..... A63H 27/14; A63H 17/00
See application file for complete search history.

(56) References Cited

U.S. PATENT DOCUMENTS

| | | | | |
|---|---|---|---|---|
| 2,735,222 A | | 2/1956 | Glass | |
| 3,679,317 A | | 7/1972 | Larson | |
| 3,859,752 A | * | 1/1975 | Morrison | A63H 17/02 280/827 |
| 3,919,804 A | | 11/1975 | Nakata | |
| 4,087,935 A | | 5/1978 | Edmisson et al. | |
| 4,236,346 A | * | 12/1980 | Iwao | A63H 11/205 446/294 |
| 4,241,534 A | | 12/1980 | Larsson et al. | |
| 4,406,084 A | | 9/1983 | D'Andrade | |
| 4,453,340 A | * | 6/1984 | Kozuka | A63H 17/40 446/288 |
| 4,493,671 A | | 1/1985 | Kennedy et al. | |

(Continued)

FOREIGN PATENT DOCUMENTS

GB 2 265 837 A 10/1993

OTHER PUBLICATIONS

International Search Report and Written Opinion issued in parallel International PCT Application No. PCT/US18/55910, dated Jan. 7, 2019, 6 pages.

*Primary Examiner* — Eugene L Kim
*Assistant Examiner* — Christopher A Glenn
(74) *Attorney, Agent, or Firm* — Lewis Roca Rothgerber Christie LLP

(57) ABSTRACT

A toy comprising a top portion having a releasable locking mechanism having flexible clamps and a bottom portion having a post with a head portion releasably engageable by the flexible clamps upon downward movement of the top portion onto the body portion, and a drive system comprising a pillar attached to the top portion having drive teeth and a gear system in the bottom portion, the drive teeth of the pillar operating the gear system in the bottom portion upon movement of the top portion away from the bottom portion by a spring positioned around the pillar such that the drive system operates after the releasable locking mechanism releases the head portion of the post from the flexible clamps.

17 Claims, 4 Drawing Sheets

(56) References Cited

U.S. PATENT DOCUMENTS

| | | | | |
|---|---|---|---|---|
| 4,541,815 | A | 9/1985 | Lee et al. | |
| 4,608,027 | A | 8/1986 | Klamer et al. | |
| 4,702,720 | A | 10/1987 | Konta et al. | |
| 5,660,575 | A | 8/1997 | Chuang | |
| 6,086,449 | A * | 7/2000 | Sharp | A63H 33/103 446/308 |
| 6,565,411 | B1 | 5/2003 | Fosbenner et al. | |
| 6,764,376 | B2 | 7/2004 | Agostini et al. | |
| 6,805,609 | B1 | 10/2004 | Paukert et al. | |
| 2006/0111013 | A1 | 5/2006 | Lau et al. | |
| 2006/0135036 | A1 | 6/2006 | Miva et al. | |
| 2006/0211331 | A1 * | 9/2006 | Trageser | A63H 29/24 446/429 |
| 2006/0252339 | A1 * | 11/2006 | Lopez | A63H 27/14 446/38 |
| 2017/0173477 | A1 * | 6/2017 | Shindo | A63H 1/04 |

* cited by examiner

TOY HAVING PUSH LOCK AND DRIVE MECHANISM

CROSS-REFERENCE TO RELATED APPLICATION(S)

This application claims priority to and the benefit of U.S. Provisional Application No. 62/577,726, filed Oct. 27, 2017, the contents of which are incorporated herein.

FIELD OF THE INVENTION

The present invention is directed to a toy having a push lock and drive mechanism having an upper or head portion connected to a lower or body portion wherein pressing the head portion downwards towards the body portion to a certain position develops potential energy within the drive mechanism and locks the head portion in position with respect to the body portion. Pressing the locked head portion downwards towards the body portion a second time unlocks and releases the head portion which is driven away from the body portion and engages the drive mechanism causing the toy to move forward.

BACKGROUND OF THE INVENTION

Self-propelled toys have existed for decades including devices for activating the toys by internal mechanisms including springs, weights, gears and batteries. Spring driven toy vehicles exist in several forms including a key for winding the spring and a lever coupled to the vehicle for releasing the energy stored in the spring for propelling the vehicle over a surface. Such devices included a ratchet or pawl mechanism which prevented the disc or shaft on which the spring was mounted from moving in the opposite direction until a lever coupled to the vehicle was released to set the toy in motion until the energy stored in the spring was expended, whereupon the key or crank would have to be turned again to restart the process. Problems with these toys included either easy loss of the key or were difficult to manipulate by small children.

Toy vehicles also utilizing spring motors were developed which included complex mechanisms enabling the spring motors to be wound by manually moving the vehicle in the reverse direction. In such devices, release of the vehicle after a predetermined movement thereof in the reverse direction enabled the vehicle to move forward under power of the spring motor which included transmission parts constructed to permit free coasting at the termination or run down of the energy output of the spring. Such toys were difficult to operate by small children and could be difficult to wind in the reverse direction. Consequently, a need exists for a self-propelled toy which is easy to operate for any age child by simply pressing down on a portion of the toy.

SUMMARY OF THE INVENTION

The present invention is directed to a toy including an upper or head portion movably connected to a lower or body portion. Positioned within the head and body portions of the toy are a locking mechanism and a propulsion mechanism wherein pressing the head portion downwardly towards the body portion to a certain position locks the head in that position with respect to the body portion. Pressing the locked head downwards again unlocks and releases the head thereby activating the drive mechanism to move the toy forward on wheels attached to the body portion. As the head portion is initially pressed downwardly toward the body portion, teeth on a pillar attached to the head portion move gears of a gear box positioned within the body portion to load the gear box with potential energy by compressing a spring positioned around the pillar. When the head is pressed downwardly again the pillar is released from the locking mechanism causing the spring to raise the head and engage the gear box causing the toy to move forward. The body portion also contains a separate drive mechanism which stores potential energy when the toy is pulled back and when the toy is consequently released the storage energy is released causing the toy to move forward. The pull-back drive mechanism works independently of the locked or unlocked status of the head portion with respect to the body portion.

Multiple variations of toys can be designed which incorporate the features of the present invention. For example, the toy can be designed as a collectible figure, a vehicle or a hybrid configuration of a collectible figure and a vehicle. The function, design and play pattern of the toy of the present invention allows for all age of children to enjoy the toy from preschoolers to teenagers. The toy of the present invention can be a collectible that has play value. The present invention has the advantage over prior self-propelled toys in that it does not require a battery or other outside source of power and is easy to operate by simply pressing down upon the head portion of the toy to activate the drive mechanism.

The toy of the present invention includes a scalable housing having an upper and lower portion positioned on a plurality of wheels and having an internal drive mechanism that causes the housing to move when the upper portion of the housing is pressed downwardly on the outside and from the top. Upon initially pressing the housing the object will remain stationary due to the locking mechanism. The toy can be played with in the locked position as a free-wheeling toy however, upon pressing down of the upper portion again the toy will automatically move forward as the upper portion rises to its original position.

These and other advantages of the present invention, the present invention will be better understood in reference to the following drawings and detailed description.

DETAILED DESCRIPTION

Figure 1:
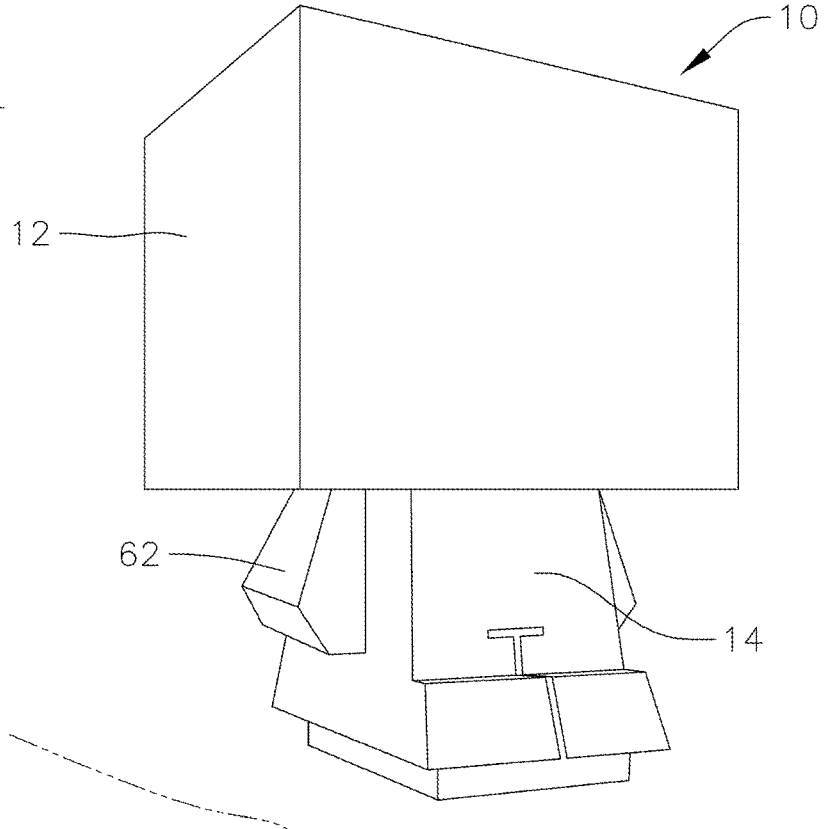
FIG. 1 is a front perspective view of the toy of the present inventions in an unlocked position.
Figure 2:
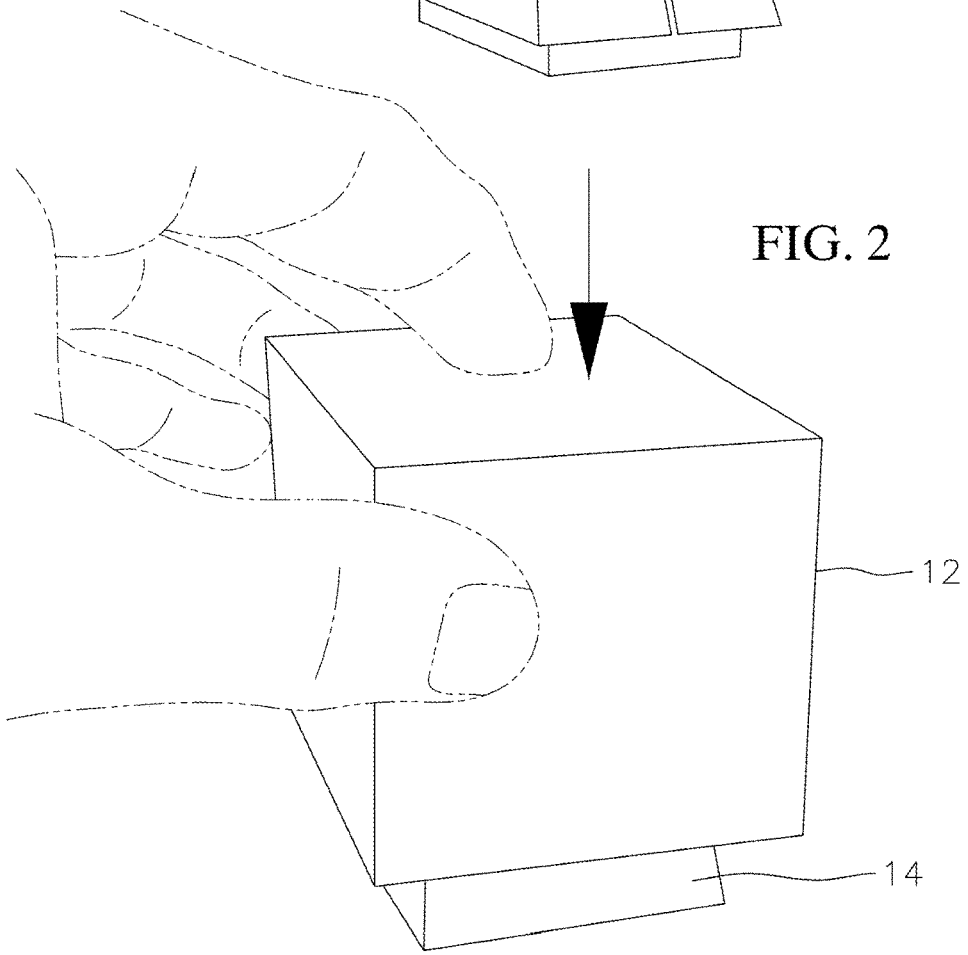
FIG. 2 is a perspective view of the toy of FIG. 1 in the locked position.

Referring to FIG. 1, a toy 10 of the present invention is illustrated. The toy includes a top or head portion 12 and a lower of body portion 14. As shown in FIG. 2, the head portion 12 can be pushed down upon the body portion 14 into a locked position. In the locked position the head portion 12 fits at least partially over the body portion 14.

Figure 3:
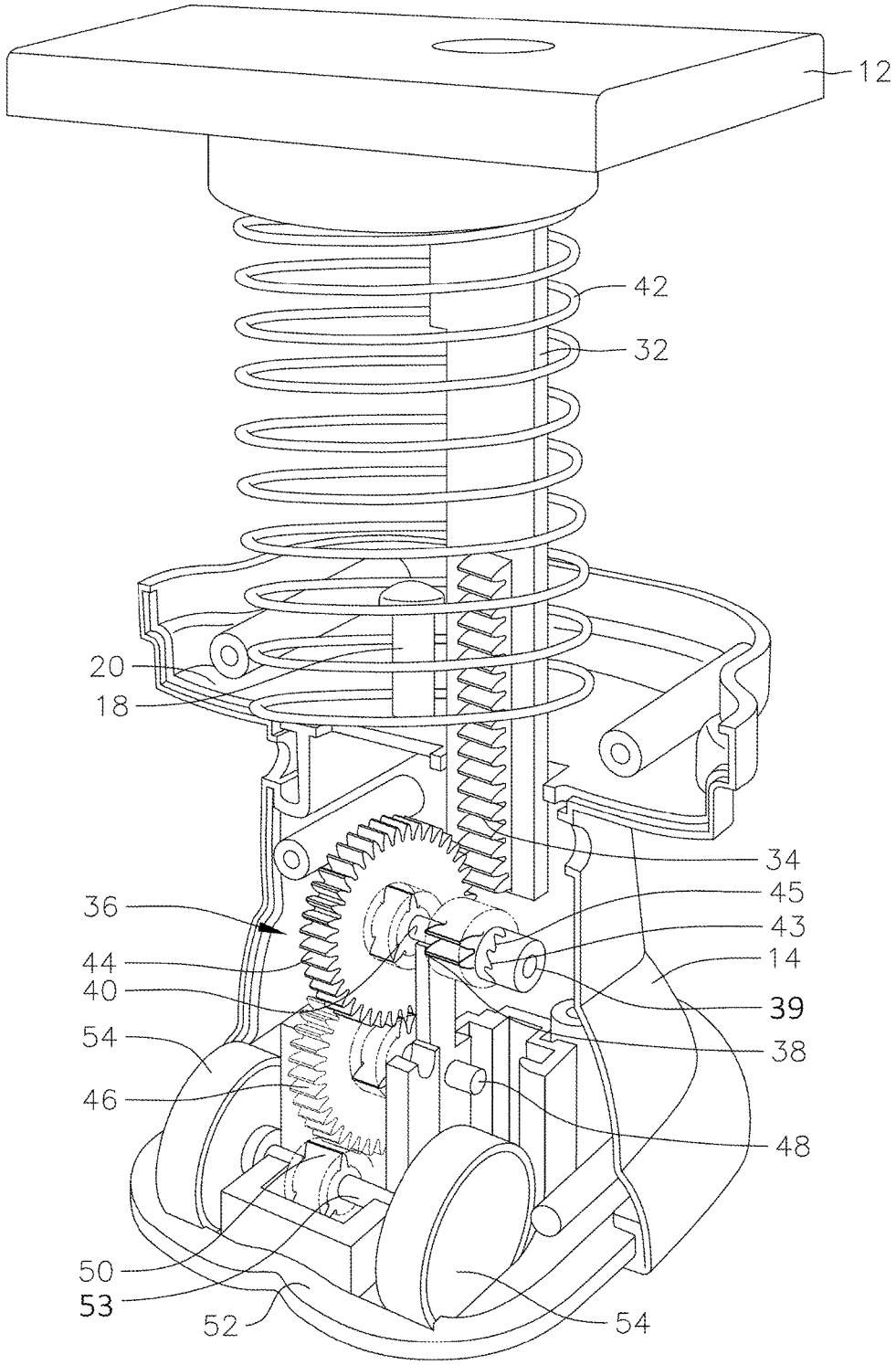
FIG. 3 is a partial cross-sectional rear view of the toy of FIG. 1.
Figure 4:
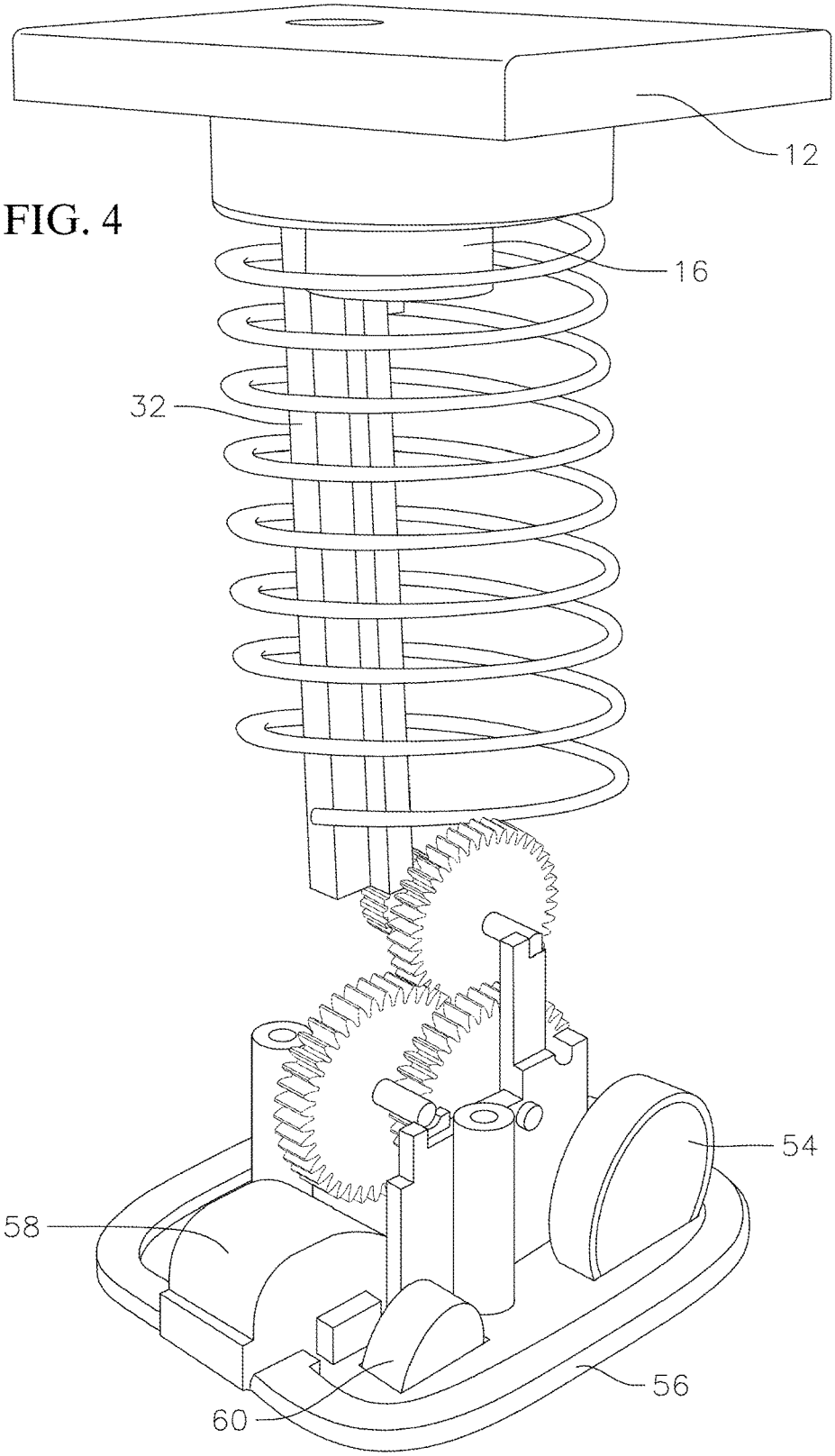
FIG. 4 is a partial cross-sectional front view of the toy of FIG. 1.
Figure 5:
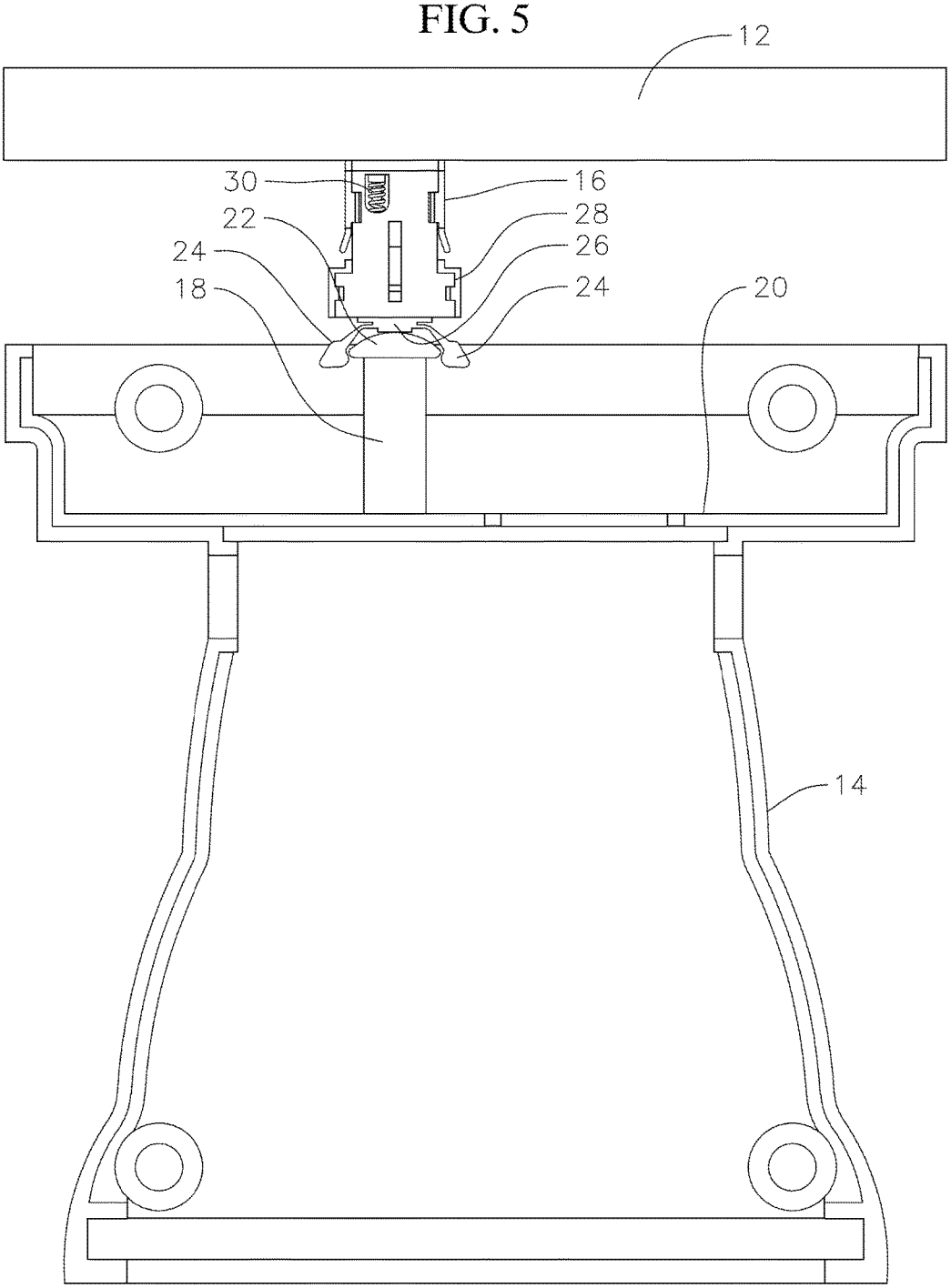
FIG. 5 is a detail cross-sectional view of the locking mechanism of the toy of the present invention.

As shown in more detail in FIGS. 3-5, the toy 10 includes a locking mechanism and a drive mechanism located within the head portion and the body portion. The locking mechanism includes a releasable lock 16 positioned within the head portion 12 which engages a post 18 located on a shelf 20 of body portion 14. Post 18 has an enlarged head 22 at the end of the post which is engaged by retractable clamps 24 on the locking mechanism 16. Clamps 24 are positioned on either side of a center portion 26 which retracts within the locking mechanism 16 when the head portion 22 is pushed down on the body portion by enlarged head 22. Clamps 24 are drawn within a housing 28 of the locking mechanism to lock the post 18 within the locking mechanism 16. The center portion 26 is biased within the housing 28 by a spring 30. To release the locking mechanism 16, the head portion 12 is pushed down again which releases the center portion 26 from the housing 28 and the spring 30 pushes the center portion 26 out of the housing thereby releasing the clamps 26 from the head 22 of post 18. Locking mechanism 16 is referred to as a push lock.

The drive mechanism as shown in FIGS. 3 and 4 includes a pillar 32 attached to head portion 12 which extends downwardly into body portion 14. Pillar 32 has drive teeth 34 which operate a gear set 36 positioned in the body portion 14. Drive teeth 34 engage gear 38 located on axle 40 positioned within the body portion below shelf 20. A spring 42 is positioned around the pillar 32 and post 18 between the shelf 20 and the head portion.

Gear set 36 includes gear 44, also positioned on axle 40 which engages gear 46 located below gear 44 and held within the body portion by axle 48, and wheel drive gear 50 positioned below gear 46 and located on axle 52. Rear wheels 54 are located on either end of axle 52.

The drive mechanism operates after the locking mechanism is released and the potential energy stored in spring 42 pushes the head portion upwardly thereby engaging drive teeth 34 on pillar 32 to engage gear 38 which through clutch 39 rotates shaft 40 to rotate gear 44 and engage gear 46 which engages gear 52 to rotate axle 53 and wheels 54. Clutch 39 prevents the gear set from turning the wheels when the head portion is pressed down initially by having one-way teeth 43 which engage clutch teeth 45 on gear 38. The gear system and wheels are positioned upon a base 56 which attaches to body portion 14.

As shown in FIG. 4, the base 56 also includes a pullback drive mechanism 58 which can be attached to front wheels 60 as another drive mechanism for the toy. The pullback mechanism 58 is a spring which stores potential energy as the toy is pulled back until being released to drive the front wheels 60.

In operation, the toy is capable of being moved by pressing on the top portion thereby compressing the spring 42 until the top portion is locked upon the body portion. Upon pressing the top portion again, the locking mechanism is unlocked and the spring drives the top portion upwardly away from the bottom portion operating the gear system to move the toy forward on the wheels. Alternatively, the toy can be moved by the pullback mechanism which operates the front wheels. The head and body portions of the toy can be of any size, shape, material as desired and can take the forms of animals, people, action figures, race cars, etc. and in certain configurations can be a plurality of interchangeable top and body portions to be used in conjunction with the locking mechanism and the drive mechanism. When the head portion is pressed down upon the body portion it can conceal the body portion until the head portion is released activating the drive mechanism as the head rises and the toy moves forward. It is further contemplated that the body portion can have other components such as moving arms 62.

Although the present invention has been described and illustrated with respect to an embodiment thereof, it is to be understood that change and modifications can be made therein which are within the full intended scope of the invention as hereinafter claimed.

What is claimed is:

1. A toy comprising: a top portion; the top portion having a releasable locking mechanism having flexible clamps; a bottom portion; the bottom portion having a post with a head portion releasably engageable by the flexible clamps upon downward movement of the top portion onto the bottom portion; and a drive system comprising a pillar attached to the top portion with drive teeth and a gear system in the bottom portion, the drive teeth of the pillar operating the gear system in the bottom portion upon movement of the top portion away from the bottom portion, wherein the drive system operates after the releasable locking mechanism releases the head portion of the post from the flexible clamps.

2. The toy of claim 1 further comprising a spring positioned between the top portion and the bottom portion around the pillar and the post for driving the top portion away from the bottom portion upon release of the head portion of the post from the flexible clamps.

3. The toy of claim 1 wherein the gear system includes a clutch to prevent operation of the gear system upon downward movement of the top portion onto the bottom portion and operation of the gear system upon movement of the top portion away from the bottom portion.

4. The toy of claim 1 wherein the drive system further comprises wheels operated by the gear system.

5. The toy of claim 1 further comprising a pullback drive mechanism.

6. The toy of claim 5 wherein the pullback mechanism is connected to at least one wheel.

7. The toy of claim 1 wherein the releasable locking mechanism is spring biased.

8. A self-propelled toy vehicle comprising:

a head portion having a releasable locking mechanism having flexible clamps;

a body portion having a post for releasable engagement by the flexible clamps, the body portion configured to at least partially fit within the head portion upon downward movement of the head portion onto the body portion and engagement of the post; and the head portion having a pillar for operating a drive gear in the body portion after release of the post from the flexible clamps and movement of the head portion away from the body portion.

9. The self-propelled toy of claim 8 wherein the post has an enlarged end portion for engaging the flexible clamps.

10. The self-propelled toy of claim 8 wherein the pillar has drive teeth for engaging the drive gear.

11. The self-propelled toy of claim 8 further comprising a spring positioned between the head portion and the body portion for driving the head portion away from the body portion upon release of the post from the flexible clamps.

12. The self-propelled toy vehicle of claim 8 wherein the drive gear comprises a gear system.

13. The self-propelled toy of claim 12 wherein the gear system includes a clutch to prevent operation of the gear system upon downward movement of the head portion onto the body portion, and operation of the gear system upon movement of the head portion away from the body portion.

14. The self-propelled toy vehicle of claim 12 further comprising wheels operated by the gear system.

15. The self-propelled toy vehicle of claim 8 further comprising a pullback drive mechanism attached to the body portion.

16. The self-propelled toy of claim 15 wherein the pullback drive mechanism is attached to at least one wheel.

17. The self-propelled toy vehicle of claim 8 wherein the releasable locking mechanism is spring biased.

* * * * *